US011401676B2

(12) United States Patent
Massari et al.

(10) Patent No.: US 11,401,676 B2
(45) Date of Patent: Aug. 2, 2022

(54) DRILLING MACHINE, ASSEMBLY PROCEDURE, AND KIT FOR A DRILLING MACHINE

(71) Applicant: SOILMEC S.P.A., Cesena (IT)

(72) Inventors: Stefano Massari, Piangipane (IT); Lucas Cecchini, Borghi (IT); Gianluca Vetricini, Cesena (IT); Daniele Villa, Rimini RN (IT)

(73) Assignee: SOILMEC S.P.A., Cesena (IT)

( * ) Notice: Subject to any disclaimer, the term of this patent is extended or adjusted under 35 U.S.C. 154(b) by 0 days.

(21) Appl. No.: 17/059,136

(22) PCT Filed: May 28, 2019

(86) PCT No.: PCT/IB2019/054401
§ 371 (c)(1),
(2) Date: Nov. 25, 2020

(87) PCT Pub. No.: WO2019/229645
PCT Pub. Date: Dec. 5, 2019

(65) Prior Publication Data

US 2021/0214910 A1 Jul. 15, 2021

(30) Foreign Application Priority Data

May 31, 2018 (IT) ..... 102018000005910

(51) Int. Cl.
*E02D 7/16* (2006.01)
*E02D 7/22* (2006.01)
*E21B 7/02* (2006.01)

(52) U.S. Cl.
CPC ..... *E02D 7/16* (2013.01); *E02D 7/22* (2013.01); *E21B 7/02* (2013.01)

(58) Field of Classification Search
CPC ..... E02D 7/16; E02D 7/22; E21B 7/02; E21B 7/023; E21B 7/022
See application file for complete search history.

(56) References Cited

U.S. PATENT DOCUMENTS 3,645,343 A * 2/1972 Mays ..... E21B 15/04 173/195
3,664,436 A 5/1972 Beagan, Jr.
2010/0319222 A1* 12/2010 Lanzl ..... E21B 7/005 37/195

FOREIGN PATENT DOCUMENTS

EP 1983147 A2 10/2008
EP 2459837 B1 1/2014

OTHER PUBLICATIONS

International Search Report and Written Opinion for PCT/IB2019/054401, dated Sep. 20, 2019.

* cited by examiner

*Primary Examiner* — Carib A Oquendo
(74) *Attorney, Agent, or Firm* — Merchant & Gould P.C.

(57) ABSTRACT

A drilling machine includes a main body, a mast to mount a drilling tool, a kinematic mechanism movably constraining the mast to the main body while allowing mutual rotation. The kinematic mechanism includes an elongated component hinged at two ends. When the drilling machine is in a drilling configuration, the elongated component performs a structural function to constrain the mast to the main body. An assembling and moving equipment includes a moving element movably mounted to the drilling machine and supporting the elongated component. A moving actuator controls the relative position between the moving element and a mounting portion of the drilling machine. When the drilling machine is in an assembling configuration, one end of the elongated component is released and the moving element (Continued)

acts upon the elongated component. Moving the moving element relative to the mounting portion of the drilling machine causes rotation of the elongated component.

23 Claims, 8 Drawing Sheets

DRILLING MACHINE, ASSEMBLY PROCEDURE, AND KIT FOR A DRILLING MACHINE

This application is a National Stage Application of International Application No. PCT/IB2019/054401, filed May 28, 2019, which claims benefit of Ser. No. 102018000005910, filed May 31, 2018 in Italy and which applications are incorporated herein by reference. To the extent appropriate, a claim of priority is made to each of the above-disclosed applications.

TECHNICAL FIELD

The present invention relates to an assembling and moving equipment and a method of using such equipment, for facilitating the assembling of components of a ground drilling machine.

BACKGROUND ART

When making foundation and ground-consolidation excavations, self-moving drilling machines are generally used, like the known one shown in FIG. 1, which are provided with an undercarriage on wheels or tracks, a rotary turret equipped with the power unit (thermal engine or electric motor), a cabin, control accessories and, typically, hoists for excavation accessories. The machine comprises a mast with sliding guides, whereon the rotary table (also known as "rotary") translates linearly, which receives power, e.g. hydraulic or electric power, from the power unit and converts it into rotary motion for moving the excavation tools. The mast is delimited at the top by a head comprising rope pulleys, through which the hoists located on the upper structure or on the mast itself can lift or lower the drill string or the excavation tools. The latter are generally left unconstrained in the axial direction, but not in the radial direction, by the rotary, which includes an autonomous lifting/lowering system.

The simplest machines are equipped with a mast moving system that, through at least one hydraulic cylinder connected to both the mast and the base machine, effects a simple rotation of the mast relative to a connection fulcrum between the mast and the base machine, so that the mast can be switched from a horizontal transport configuration to a tilted or vertical working configuration. The distance between the excavation axis (or the axis of rotation of the tool in excavation conditions) and the axis of rotation of the turret is referred to in the industry as "working radius". In the simplest machines, the variation of the working radius, when present, is effected by a slide that moves the whole mast supporting frame by a few tens of centimetres relative to the turret. More complex machines have a mast moving system that includes an additional hydraulic cylinder, which, by actuating a parallelogram-shaped kinematic mechanism, allows changing the working radius while keeping the mast angle constant. As an alternative, the second actuator may move a kinematic element directly in contact with the mast that is not of the parallelogram type and anyway for its simplicity and versatility allows changing the working radius while requiring a subsequent adjustment of the angle of inclination of the mast or antenna.

In order to prepare the machine for road transport out of the excavation site, it is necessary to lay down the mast into a substantially horizontal position, so that the total height of the machine in the transport configuration is as short as possible and allows complying with the height limits imposed by traffic regulations. In small-sized and medium-sized machines, the mast can be laid down either backwards onto the turret or forwards, in a cantilever fashion, in front of the cabin.

The demand for increasingly higher performance from excavating machines has led to a general increase in the dimensions and weights of big machines. This comes from the need for more powerful on-board components, higher mechanical strength of the structural parts, and increased excavation depths and diameters.

One consequence of such increased dimensions and weights consists of more complex machine transport phases. In fact, in order to be able to comply with the maximum weight limits allowed for road circulation of the vehicles to be used for transporting the excavating machine, it is often necessary to dismount some components from the machines during the transport phases. Likewise, in order to be able to comply with the maximum height limits allowed for road circulation of the vehicles to be used for transporting the excavating machine, it is often necessary to dismount those components which are highest when the machine is in the transport configuration. Excavation accessories and the rotary are often removed, but in the biggest machines it may become necessary to dismount the mast as well, separating it from the associated kinematic system or, more in general, from the base machine.

It follows that such components will then have to be reinstalled after reaching the working site, in order to bring the machine back into excavation operating conditions. Likewise, once on-site work is complete, such components will have to be dismounted again on site before the machine can be transported on the road again.

Mounting and dismounting bulky and heavy components of a machine, such as, for example, the mast, is a complex process that may turn out to be particularly difficult to carry out on site, where it is often the case that one cannot utilize the same equipment and structures that are available at a shop or at the manufacturing plant. As a consequence, assembly operations cannot be carried out on site with the same degree of safety.

In particular, it may turn out to be difficult to mount those components which are to be constrained to other structures of the machine through two distinct connection points providing two fulcrums. For example, the mast is an element that must be constrained to the base machine (or to the kinematic mechanism of the base machine) through a first connection fulcrum and also to the mast rotation actuator (generally a hydraulic cylinder) through a second connection fulcrum. Likewise, the mast rotation actuator must be constrained to the base machine (or to the kinematic mechanism of the base machine) through a first connection fulcrum and also to the mast through a second connection fulcrum. During the assembly process, the first connection fulcrum of the mast is connected to the base machine and, in the same manner, the first connection fulcrum of the mast rotation actuator is connected to the base machine; subsequently, the second connection fulcrum of the mast is connected to the second connection fulcrum of the mast rotation actuator. This second connection between the mast rotation actuator and the mast is particularly difficult because both the mast and the actuator are free to rotate about a fulcrum of their own and must therefore be mutually oriented until the second connection fulcrum of the mast becomes coaxial to the second connection fulcrum of the actuator. This step requires the availability of two distinct hoisting means, e.g.

two support cranes, in order to be able to support and move both components independently until correct mutual orientation is achieved.

In the prior art, said assembling phase is usually carried out by following a procedure that will now be described with reference to a known machine 100 illustrated in FIG. 1. The drilling machine 100 is of a known typology and comprises a machine body, in turn comprising a self-moving undercarriage 4 and a rotary turret 3. The turret 3 comprises an control cabin for the operator.

The drilling machine 1 further comprises a mast 5 and a kinematic mechanism 2 for moving the mast 5 relative to the turret 3. The kinematic mechanism 2 is connected to the turret 3 on one side and to the mast 5 on the other side. The kinematic mechanism 2, which is of the parallelogram type, moves the mast 5 while allowing adjusting the drilling height relative to the centre plate (also called working radius). The movement of the kinematic mechanism 2 is effected by at least one jack 6 acting upon the arm 7. The arm 7 has a first end hinged to the turret 3 and a second end hinged to a kinematic frame 8, usually referred to as "trapezium" or "trapezoid frame". The trapezoid frame 8 is also connected to the turret 3 by means of at least one connecting rod 9 having the same length as the arm 7, thus forming an articulated parallelogram.

The trapezoid kinematic frame 8 has, in its front part, a mast connecting fulcrum 8*a* (shown in detail in FIG. 2), configured to be coupled to a corresponding joint 5*a* on the mast through a pin-type connection. This connection allows the mast 5 to rotate forwards about the fulcrum 8*a* of the kinematic frame 8, and possibly to make also small lateral rotations, when the joint 5*a* is a cardan joint.

In a known variant, the jack 6 for moving the arm 7, instead of being directly associated with the kinematic frame 8, is associated with the arm 7. In those solutions using a parallelogram-type kinematic mechanism, by actuating the jack 6 acting upon the arm it is possible to cause the mast 5 to translate from a position in which the working radius is minimum to a position in which the working radius is maximum, while keeping the tilting angle thereof constant. At least one mast rotating cylinder 10, which connects the mast 5 to the kinematic frame 8, effects the lifting and lowering of the mast and adjusts the inclination thereof relative to the ground. This movement allows the mast 5 to switch from a substantially horizontal position, or transport position, to a substantially vertical position, or working position.

On the mast 5 there is a rotary 11, equipped with a per se known pull-push system 12. Through the rotary 11 a drilling assembly is arranged, such as a string of telescopic rods or kelly 13. The string of telescopic rods 13 is provided with an excavation tool 14, which may be, for example, a bucket or a helical drill; in particular, the excavation tool 14 is secured to the bottom end of the innermost rod of the string of telescopic rods 13, so as to be able to receive torque and thrust from said rod.

The procedure for mounting the mast on a machine of a known type can be described with reference to FIGS. 2*a* and 2*b*. FIG. 2*a* shows a side view of the machine during an assembling phase wherein the mast 5 is completely separated from the kinematic mechanism 2 and from the base machine. FIG. 2*b* shows a side view of the machine during an assembling phase wherein the mast 5 is partially separated from the kinematic mechanism 2 and from the base machine, while it is still connected to the kinematic mechanism at one point only, i.e. at the fulcrum between the kinematic support 8 and the mast 5.

In order to be able to install the mast on the machine in accordance with the prior art, the machine is first arranged with the kinematic mechanism in the lowered position and with the arm 7 only slightly tilted relative to the ground, so that the fulcrum 8*a* on the trapezium 8, to be connected to the mast, is slightly above the upper structure 3 and the cabin. In this condition, the mast tilting cylinder 10 has one end hinged to the trapezium 8 and is tilted backwards relative to the turret 3, so that the second end of the cylinder 10, to be connected to the mast 5, is above the turret. The cylinder 10, which would otherwise be free to rotate about the first fulcrum, is locked in position by interposing removable mechanical locators between the arm (or another part of the base machine) and the cylinder, or else by fastening it with a sling. Therefore, this step of locking the cylinder 10 requires the presence of personnel near the kinematic mechanism, in a poorly accessible, elevated area, for applying the cylinder locking means. This is therefore a dangerous task, especially when carried out on site.

The mast 5 is slung and hoisted by means of hoisting means, such as a bridge crane or a service crane, and is positioned over the machine. For simplicity, FIGS. 2*a* and 2*b* only show the hook of such hoisting means and the associated slings connecting the mast 5 to the hook. By adjusting the length of the sling branches before hoisting the mast, it is possible to set the angle of inclination that the mast will take when lifted. If a single hoisting means is used, it will not be possible to adjust the angle of inclination after hoisting the mast 5. Instead, if the mast is hoisted in a combined manner by using two distinct hoisting means, e.g. two service cranes, so that each one of the two means will grasp the mast near one end thereof, it will be possible to change the inclination of the mast even after hoisting it, by moving each hoisting means independently. This solutions is much more complex and costly, in that combined hoisting requires particular safety procedures and accurate planning, especially when carried out on site.

The mast 5 is then brought close to the kinematic mechanism 2 by moving it through the hoisting means, while the kinematic mechanism is kept in a fixed position. The mast 5 is moved until the fulcrum 5*a* of the joint of the mast 5 matches the mast connecting fulcrum 8*a* on the trapezium 8. When the fulcrums 8*a* and 5*a* are coaxially aligned, a pin can be inserted in order to couple the two parts together. This step is difficult because the hoisting means, e.g. cranes or bridge cranes, allow for neither high precision nor fine adjustment of movements; therefore, achieving sufficient coaxiality to be able to insert the pin may require many manoeuvres and much time.

Once the connecting pin between the mast 5 and the kinematic support 8 has been inserted, the machine 100 will be in the condition shown in FIG. 2*b*, with the mast 5 connected to the trapezium 8, but still not constrained to the mast 5 tilting cylinder 10, which must be connected to a second fulcrum 5*b* on the mast 5. In this condition, by moving the suspension means it would be possible to rotate the mast about the fulcrum 5*a*, 8*a*, but this manoeuvre must be avoided because the mast 5, being long and heavy, might hit the turret 3 or the cylinder 10 and cause damage thereto. The solution most commonly employed envisages the use of an additional hoisting means, such as a service crane or a bridge crane, for slinging the mast tilting cylinder 10 and turning it about its first fulcrum that connects it to the trapezium 8. Such movement of the cylinder 10 can only be effected after a person has come near the kinematic mechanism and has taken care of slinging the cylinder 10 and removing any removable devices used for supporting or locking the cylinder 10. The presence of personnel in the area of the machine implies risks as far as safety is concerned.

By using a second hoisting means, distinct from the one(s) used for hoisting the mast 5, the cylinder 10 is moved by changing its angle of inclination and turning it about its first fulcrum, through which it is hinged to the trapezium 8, until the second fulcrum of the cylinder 10 becomes coaxial to the fulcrum 5*b* of the mast. In addition to changing the angle of inclination of the cylinder 10, it may also be necessary to change the length thereof by hydraulically actuating it in order to move its rod.

Once coaxiality has been obtained between the fulcrum of the cylinder 10 and the fulcrum 5*a* of the mast, it is possible to insert the pin and connect the two components cinematically to each other. Once connected, the mast can be tilted by actuating the cylinder 10.

It is clear that, during the assembling phase of the machine 100 shown in FIG. 2*b*, the movements of the cylinder 10 effected by means of a crane or another hoisting means cannot be effected with millimetre precision in the displacement; therefore, reaching sufficient coaxiality to allow inserting the pin may require many manoeuvres and much time.

Similar problems arise during the phase of dismounting the mast 5, which follows a procedure that is substantially inverse to the above-described installation procedure. The mast 5 is tilted backwards and the kinematic mechanism 2 is lowered to bring the fulcrum 8*a* just above the turret 3. After slinging the mast 5, this is supported by means of a first hoisting means, such as a crane or a bridge crane, whereto the slings are hooked. At this point, it is necessary to first remove the pin that connects the cylinder 10 to the fulcrum 5*b* of the mast. In order to carry out this step, it is also necessary to support the cylinder 10 with a second hoisting means, so as to prevent said cylinder, following the extraction of the connecting pin, from falling under its own weight, turning about the remaining fulcrum connecting it to the trapezium. This rotation might be particularly dangerous because of the weight of the cylinder, which might hit other components of the machine, thus damaging them, and also because during the pin removal operations some personnel may be present in the vicinity. Subsequently, while still supporting the mast 5 with a hoisting means, the connecting pin between the fulcrum 8*a* of the kinematic support 8 and the fulcrum 5*b* of the mast 5 must be extracted. The extraction of this pin may turn out to be problematical as well in that, once the cylinder 10 has been released from the mast 5, part of the mast's weight will be borne by the connection between the fulcrum 8*a* of the trapezium 8 and the fulcrum 5*a* of the mast. This weight portion, although much less than the entire mast's weight, since the mast 5 is supported by the hoisting means, is however sufficient to considerably increase the friction of the connecting pin at the fulcrums 8*a* and 5*a*. This results in greater difficulty in extracting the pin and consequent longer disassembly times.

The simultaneous use of two distinct hoisting means for moving the mast 5 and the cylinder 10 while assembling the excavating machine 100, wherein each one of the two hoisting means is connected to the mast or to the cylinder through flexible connecting means, such as chains or slings, turns out to be very complex and problematical. In fact, the slings of one of the two hoisting means may interfere with the slings of the other means or with one of the two components to be assembled together.

SUMMARY OF THE INVENTION

It is one object of the present invention to overcome the above-mentioned drawbacks, and particularly to provide an equipment and a method for assembling components of a drilling machine, which can reduce the risks deriving from movements of hinged or constrained components, e.g. hydraulic cylinders, and assembly times, in a simple and easy way for the operator.

This and other objects of the present invention are achieved through a drilling machine, a method of assembling the drilling machine, and an assembling and moving equipment as set out in the independent claims.

Further optional features of the assembling and moving equipment, machine and method are set out in dependent claims. The annexed claims are an integral part of the technical teachings of the present description.

BRIEF DESCRIPTION OF THE DRAWINGS

The features and advantages of the present invention will become more apparent from the following non-limiting description provided by way of example with reference to the annexed schematic drawings, wherein.

DETAILED DESCRIPTION OF THE INVENTION

Figure 1:
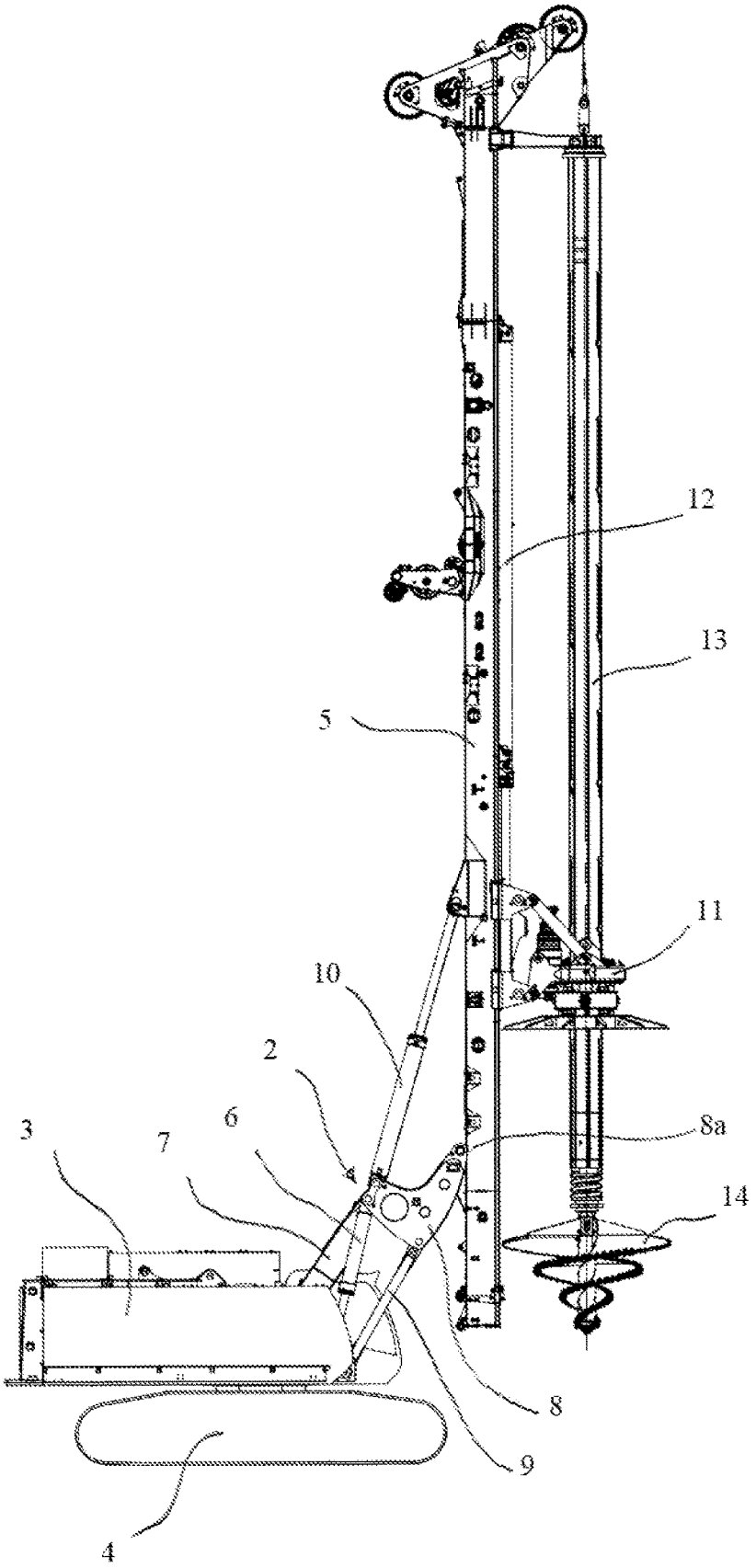
Fig.1 (prior art)
FIG. 1 is a side elevation view of a drilling machine for building piles according to the prior art, in a working configuration.
Figure 2A:
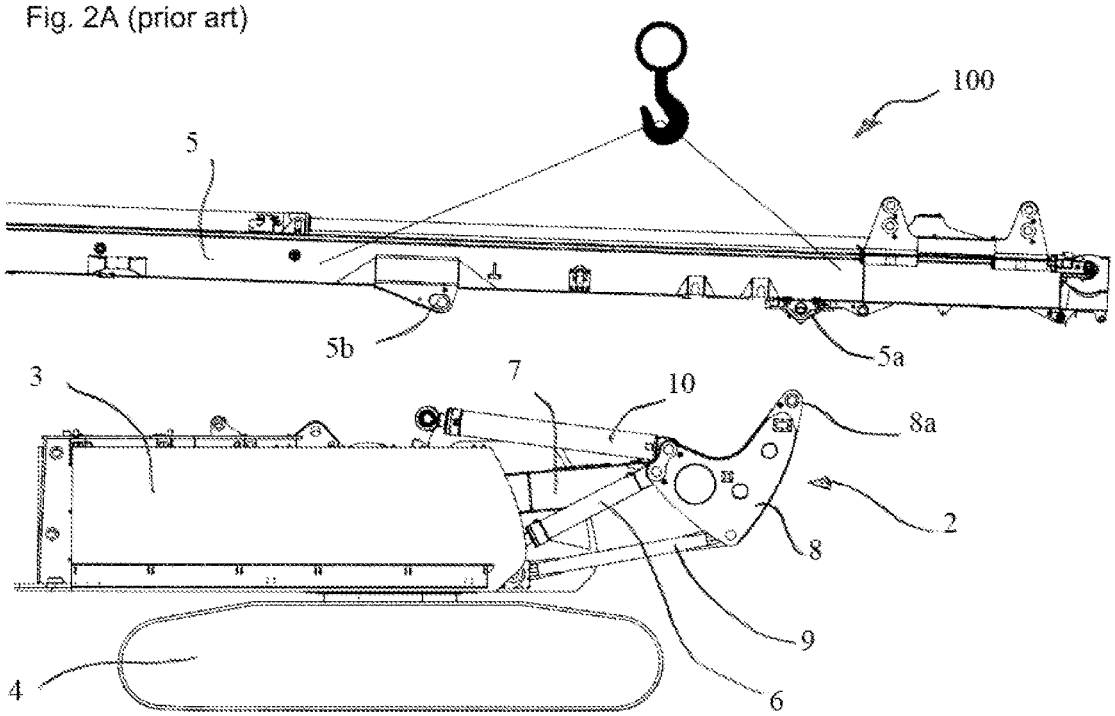
Fig. 2A (prior art)
FIGS. 2A and 2B are two side elevation views of a drilling machine for building piles according to the prior art, respectively in a first assembling or disassembling configuration, with the mast completely separated and unconstrained from the base machine or from the kinematic mechanism, and in a second assembling or disassembling configuration, with the mast constrained to the base machine at one fulcrum only.
Figure 2B:
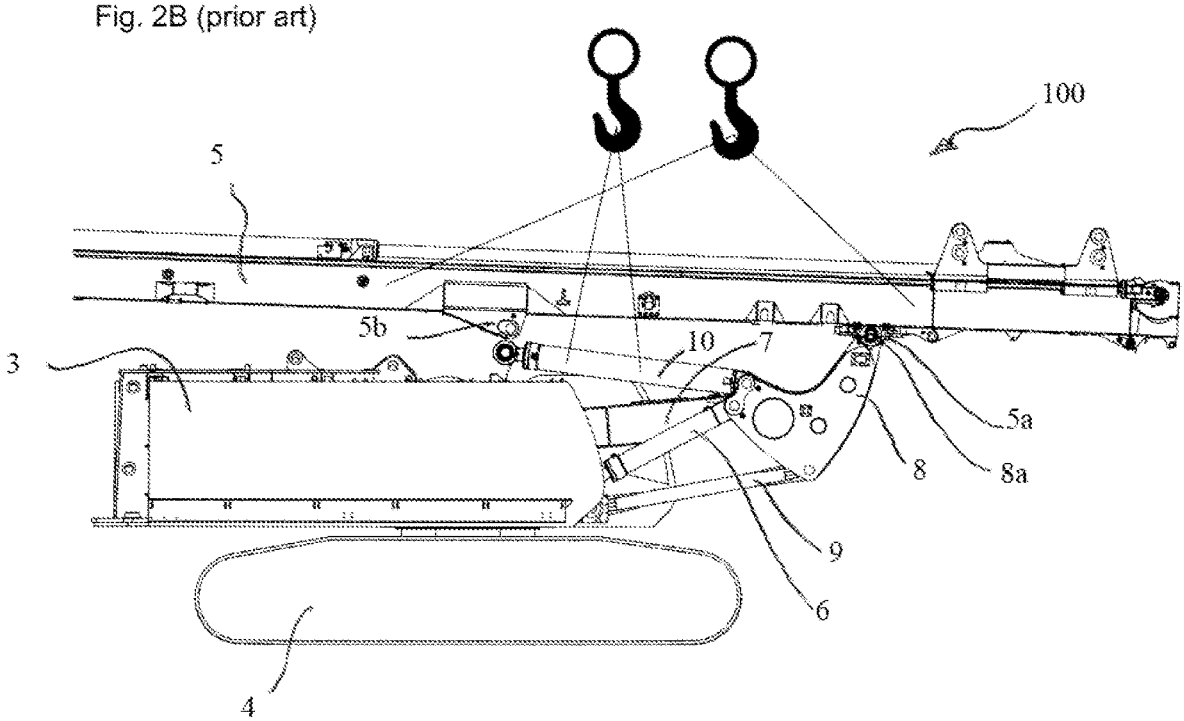
Fig. 2B (prior art)

Those parts or elements which are similar to, or perform the same function as, those of the known drilling machine designated as 100 and previously described with reference to FIGS. 1, 2A and 2B have been assigned the same alphanumerical references. For brevity's sake, as regards the machine 1 reference should be made to the above description of the background art referring to the machine 100, which is considered to be incorporated into said detailed description.

The following will briefly describe the drilling machine 1 shown in the drawings by way of non-limiting example. The drilling machine 1, which is conveniently equal to the prior-art one shown in FIGS. 1, 2A, 2B, comprises a main body, which in particular comprises, in its turn, a self-moving undercarriage 4 and an turret 3, which is advantageously of the rotary type. The turret 3 comprises an operator cabin. The drilling machine 1 further comprises a mast 5 and a kinematic mechanism 2 for moving the mast 5 relative to the main body, in particular to the turret 3.

The kinematic mechanism 2 is connected on one side to the main body (e.g. to the turret 3) and on the other side to the mast 5. The kinematic mechanism 2 comprises an arm 7 having a first end hinged to the main body and a second end hinged to a kinematic frame 8. The kinematic frame 8 is further connected to the main body (e.g. to the turret 3) through at least one connecting rod 9, thus forming an articulated parallelogram. A linear actuator 6, e.g. a jack, is mounted to the main body and to the kinematic frame 8 for moving the kinematic frame 8.

The kinematic frame 8 has, in its front part, a connecting joint 8*a* configured to be coupled to a corresponding joint 5*a* on the mast through a pin-type connection. This connection allows the mast 5 to rotate forwards about the fulcrum 8*a* of the kinematic frame 8, and possibly also to make small lateral rotations, when the joint 5*a* is a cardan joint.

In one possible variant, instead of being directly hinged to the kinematic frame 8, the linear actuator 6 is hinged to the arm 7. The actuation of the linear actuator 6 allows the mast 5 to be translated from a position having the minimum working radius to a position having the maximum working radius, while keeping the angle of inclination thereof constant.

There is at least one first linear actuator (in particular having a cylinder 10), which connects the mast 5 to the kinematic frame 8, for adjusting the inclination of the mast 5 relative to the kinematic frame 8, and hence relative to the ground. This movement allows the mast 5 to switch from a substantially horizontal position, or transport position, to a substantially vertical position, or working position. The mast 5 is therefore hinged at two points, or fulcrums: one connecting it to the kinematic frame 8 and one connecting it to one end of the first linear actuator. The first linear actuator will hereafter also be referred to as "cylinder 10", without however limiting the scope of the invention. Unlike the machine 100 previously described, the machine 1 is fitted with an assembling and moving equipment 20*a*, 20*b*, wherein such equipment is implemented in accordance with one exemplary embodiment of the present invention.

The drilling machine 1 of the present invention comprises:

a main body, a mast 5, whereon a drilling tool 14 is to be mounted, a kinematic mechanism 2 configured for movably constraining the mast 5 to the main body while allowing mutual rotation thereof, wherein the kinematic mechanism 2 includes at least one elongated component configured for being hinged at its two ends, an assembling and moving equipment 20*a*, 20*b*, comprising:

a moving element movably mounted to a portion of the drilling machine 1, and adapted to support the at least one elongated element, a moving actuator 22 adapted to control the relative position between the moving element and the portion of the drilling machine 1 to which the moving element is mounted.

The assembling and moving equipment 20*a*, 20*b* is configured in a manner such that, when the drilling machine 1 is in an assembling configuration, in which one end of the elongated component is released and the moving element is acting upon the elongated component, the movement of the moving element relative to the portion of the drilling machine 1 to which it is mounted will cause a rotation of the elongated component.

In particular, the elongated component is a first linear actuator with a rod and a cylinder 10. The first linear actuator has, in the variant shown herein, one end hinged to the mast 5.

The elongated component is meant to be an element that, when the drilling machine 1 is in an operating condition (i.e. when the kinematic mechanism 2 has been installed and is supporting the mast 5), is hinged at both of its own ends. The elongated component may also be a connecting rod, e.g. like those designated as 7, 9. The elongated element is configured for transmitting an axial force passing through its two hinging points.

Conveniently, the moving element includes a freely rotatable support roller 24 adapted to rest on the elongated component, in particular on the first linear actuator (preferably on the cylinder 10) in order to allow the elongated component to slide on the support roller 24.

In the preferred example shown herein, the machine comprises a support base 21 adapted to be removably fixed to a portion of the drilling machine 1. The moving element is mounted movably relative to the support base 21, and the moving actuator 22 is adapted to control the relative position between the moving element and the support base 21. In particular, the support base 21 is mounted to the kinematic mechanism 2, conveniently to the arm 7.

Preferably, the moving element comprises a moving arm 23*a*, 23*b* hinged to the portion of the drilling machine 1, and the moving actuator 22 is adapted to control the relative angular position between the moving arm 23*a*, 23*b* and the portion of the drilling machine 1 to which the moving arm 23*a*, 23*b* is hinged.

In particular, the moving element is a moving arm 23*a*, 23*b* hinged to the support base 21. The rotation of the moving arm 23*a*, 23*b* relative to the support base 21 can cause a rotation of the elongated component. The moving actuator 22 is adapted to control the relative angular position between the support base 21 and the moving arm 23*a*, 23*b*.

Preferably, the moving actuator 22 is a linear actuator hinged to the support base 21 and to the moving arm 23*a*, 23*b*, and conveniently comprises a cylinder and a rod; for example, the moving actuator 22 is a hydraulic or pneumatic cylinder. In the example, the main body includes the turret 3, which is preferably rotatable. The moving arm 23*a*, 23*b* has the merit of being compact, especially when it is in the lowered or idle position, in which position it does not act upon the cylinder 10.

In accordance with one possible variant, the moving element can slide linearly relative to the support base 21, being for example a fork conveniently including the support roller 24. In accordance with a further variant, the moving element is a kinematic mechanism, e.g. a compound lever, or a parallelogram-type jack (e.g. similar to a car jack), or a pantograph actuator.

In accordance with one possible variant of the invention, the support base 21 is absent and the moving element is constrained movably, e.g. by means of a hinge, to a portion of the drilling machine 1, such as an element of the kinematic mechanism 2, e.g. the arm 7. For example, two hinge-type connections 21*a*, 21*b* are integral with (e.g. welded to) a portion of the machine (e.g. the arm 7), to which the moving actuator 2 and the moving arm 23*a*, 23*b* are pivoted.

In the present embodiment, the moving element (e.g. the moving arm 23*a*) acts upon only one respective elongated element (e.g. cylinder 10). In accordance with one possible variant of the invention, the moving element acts upon a plurality of elongated elements; for example, a single moving arm 23*a* acts upon two cylinders 10. In accordance with a further possible variant of the invention, a plurality of moving arms act upon only one respective elongated element; for example, two moving arms 23*a* act upon one cylinder 10. The drilling machine shown herein by way of example has a plurality of, in particular two, assembling and moving equipment 20*a*, 20*b*; it is however possible to employ a single assembling and moving equipment.

Preferably, the moving element is adapted to take an idle condition in which it does not act upon the elongated component, and an operating condition in which it acts upon the elongated component. In the idle condition, the moving element is spaced apart from the elongated component; in the operating condition, the moving element rests on the elongated component. When the elongated component (e.g. the actuator with the cylinder 10) is hinged at its two ends, the moving element will be in the idle condition, thus not interfering with the hinged element; when the elongated component is not constrained at one end, the moving element will be in the operating condition for moving or supporting said elongated component.

Figure 3:
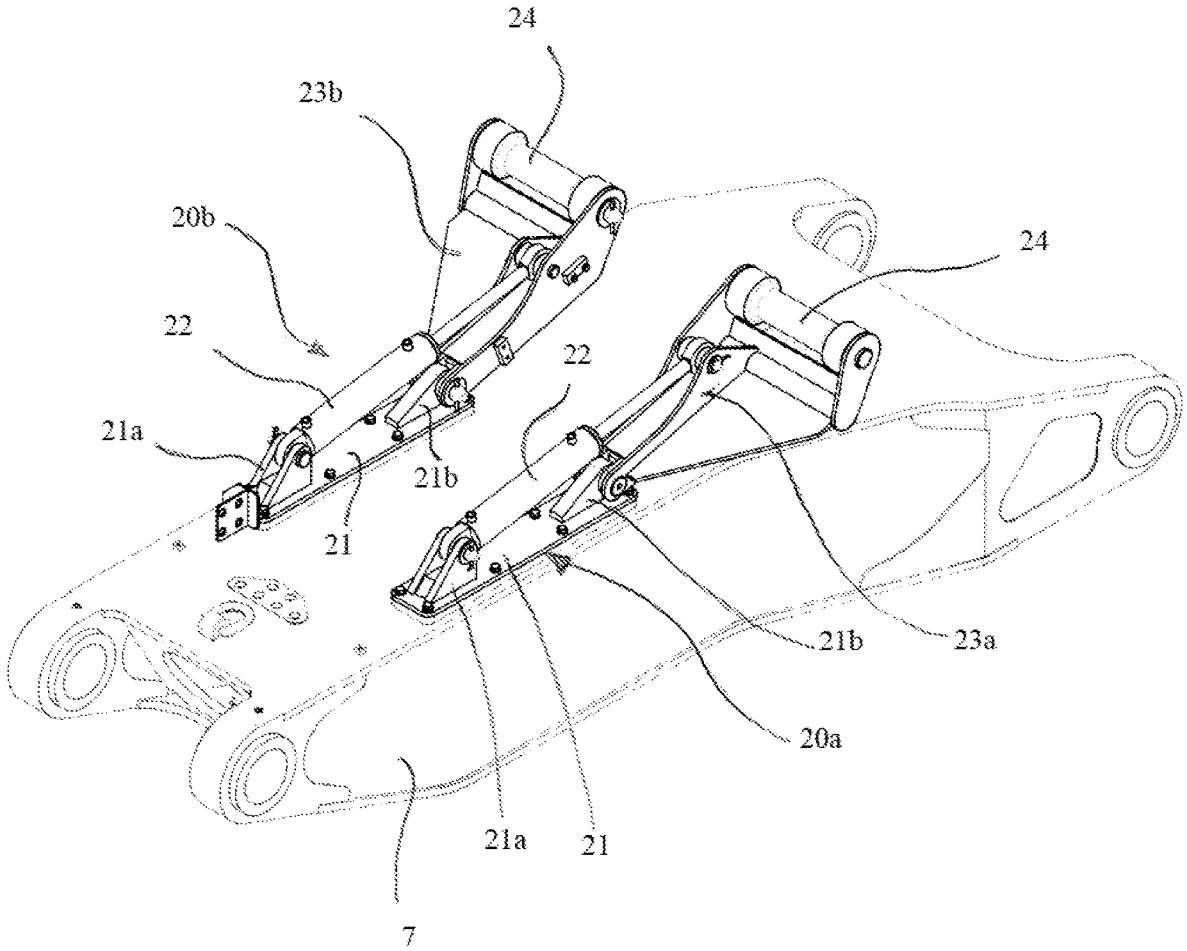
FIG. 3 is a perspective view of a pair of assembling and moving equipment according to the present invention, installed on the arm of the drilling machine.

FIG. 3 shows an embodiment of the assembling and moving equipment 20*a*, 20*b* for assembling and moving components of the machine 1. In particular, it shows a pair of said equipments installed on the arm 7. In particular, the pair of equipments 20*a*, 20*b* are configured to be able to install and move the cylinders 10 for rotating the mast 5. In FIG. 3 the cylinders 10 are not shown in order to make the equipments 20*a*, 20*b* more visible, but the relative positions of the cylinders and of the assembling and moving equipments are shown even more clearly in the next FIGS. 4, 5, 6. Still with reference to FIG. 3, the assembling and moving equipment 20*a* comprises a support base 21, which allows fixing the equipment 20*a* to the machine 1 and supporting the remaining movable parts of the equipment 20*a*. The support base 21 shown in the drawing has a flat base plate fitted with fastening means, which in the construction solution of FIG. 3 consist of holes and screws, for screwing it to a corresponding counterplate welded to the arm 7 and comprising threaded holes. The support base 21 further comprises two hinge joints 21*a*, 21*b*, whereto the rotary parts 22 and 23*a* of the equipment are constrained by means of a pin connection. The equipment 20*a* further comprises a moving arm 23*a*, which has a first end hinged to the joint 21*b*, so as to be able to rotate relative to the hinge joint 21*b*. At its second end, the moving arm 23*a* is prearranged for installation of a support roller 24, which is conveniently constrained to the moving arm 23*a* by means of a pin. The support roller 24 can turn about its constraining pin, i.e. it can rotate about its own longitudinal axis. The moving arm 23*a* is equipped, in an intermediate position of its structure, with a hinging joint for connecting an actuator 22 for moving the arm 23*a*. The moving actuator 22 is a linear actuator, which has a first end hinged to the joint 21*a* of the support base 21 and a second end constrained to the joint of the moving arm 23*a*. The actuator 22 is generally a hydraulic cylinder with a sliding rod, but in other construction variants it may be an electric or pneumatic linear actuator.

The assembly comprising the support base 21, the actuator 22 and the moving arm 23*a*, once such components have been constrained to each other, forms a simple kinematic mechanism. The actuation of the moving actuator 22 causes a rotary movement of the moving arm 23*a* and support roller 24 relative to the hinge of the hinging joint 21*b*. This movement results in the roller 24 moving away from or closer to the support base 21, in particular in a direction that is substantially perpendicular to the base plate, and therefore substantially perpendicular to the fixing surface. Advantageously, the moving actuator 22 allows for slow and accurate movements of the moving arm 23*a*, e.g. through the use of a limited oil flow, in case of a hydraulic actuator, or through an accurate voltage or current adjustment, in case of an electric actuator. The assembling and moving equipment 20*a*, 20*b* can thus be used, when assembling and fitting the drilling machine 1, for moving parts of the machine itself, particularly structures equipped with two hinges, which are first constrained to the machine 1 through a first hinge and then need to be oriented with high precision to make it possible to constrain also the second hinge to the machine 1. In particular, the equipment must be secured to the machine in a position between a fixed component of the machine 1 and that part of the machine which needs to be moved for the assembling operation (in the example, the cylinder 10 of the first linear actuator).

The part of the machine 1 that needs to be moved, after having been constrained at a first fulcrum, is made to rest on the support roller 24 and the moving actuator 22 is operated in order to move the moving arm 23*a* until the correct orientation of the part to be moved is obtained, which allows constraining also the second hinge of said moved part. The support roller 24 preferably has a self-centring shape adapted for housing the component to be moved and suitable for preventing or limiting any undesired lateral movements of such component. For example, in a first embodiment shown in FIG. 3 the support roller 24 may have a substantially cylindrical shape with a central cylindrical section having a smaller diameter than the two terminal parts of the roller. Thus, the two terminal sections of the support roller 24, which have a greater diameter, act as "shoulders" stopping any lateral movements. Other shapes are nevertheless conceivable for the support roller 24 to suit the shape of the component that needs to be moved. For example, the support roller 24 may have an hourglass or double-cone shape, with a smaller central portion, if the component to be moved has a cylindrical shape. The support roller 24 is constrained to the arm 23*a* in a manner such as to be able to rotate about its own longitudinal axis; this rolling action provides compliance with the relative movement generated between the support roller 24 and the part being moved during the actuation of the arm 23*a*. For example, the support roller 24 is essentially a sleeve that is free to rotate about a support pin integral with the arm 23*a*, 23*b*. The rolling of the support roller 24 avoids creeping between the roller and the part to be hoisted, thereby reducing friction and preventing the parts in mutual contact from wearing out.

The use of the assembling and moving equipment 20*a*, 20*b* turns out to be particularly advantageous, for example, during the steps of assembling a drilling machine 1 in order to simplify and speed up the steps of connecting the cylinders 10 for rotating the mast 5 to the mast 5 itself. Since the kinematic mechanism of the drilling machine 1 very often includes a pair of cylinders 10 arranged side by side and protruding outwards from the opposed sides of the arm 7, it is conceivable to mount on the arm 7 a pair of assembling and moving equipments 20*a*, 20*b* as shown in FIG. 3. More in detail, the assembling and moving equipments 20*a*, 20*b* are secured to the top surface of the arm 7, and their support bases 21 are disposed in proximity to the opposed sides of the arm 7. The two equipments 20*a*, 20*b* only differ from each other in the shape of the moving arms 23*a*, 23*b*, which are specular to each other, so as to protrude in opposite directions from the respective support base 21 and from the arm 7.

An advantageous installation position for the equipments 20*a*, 20*b* on the drilling machine 1 and a way of using them can be better described with reference to FIGS. 4, 5, 6 and 7.

Figure 4:
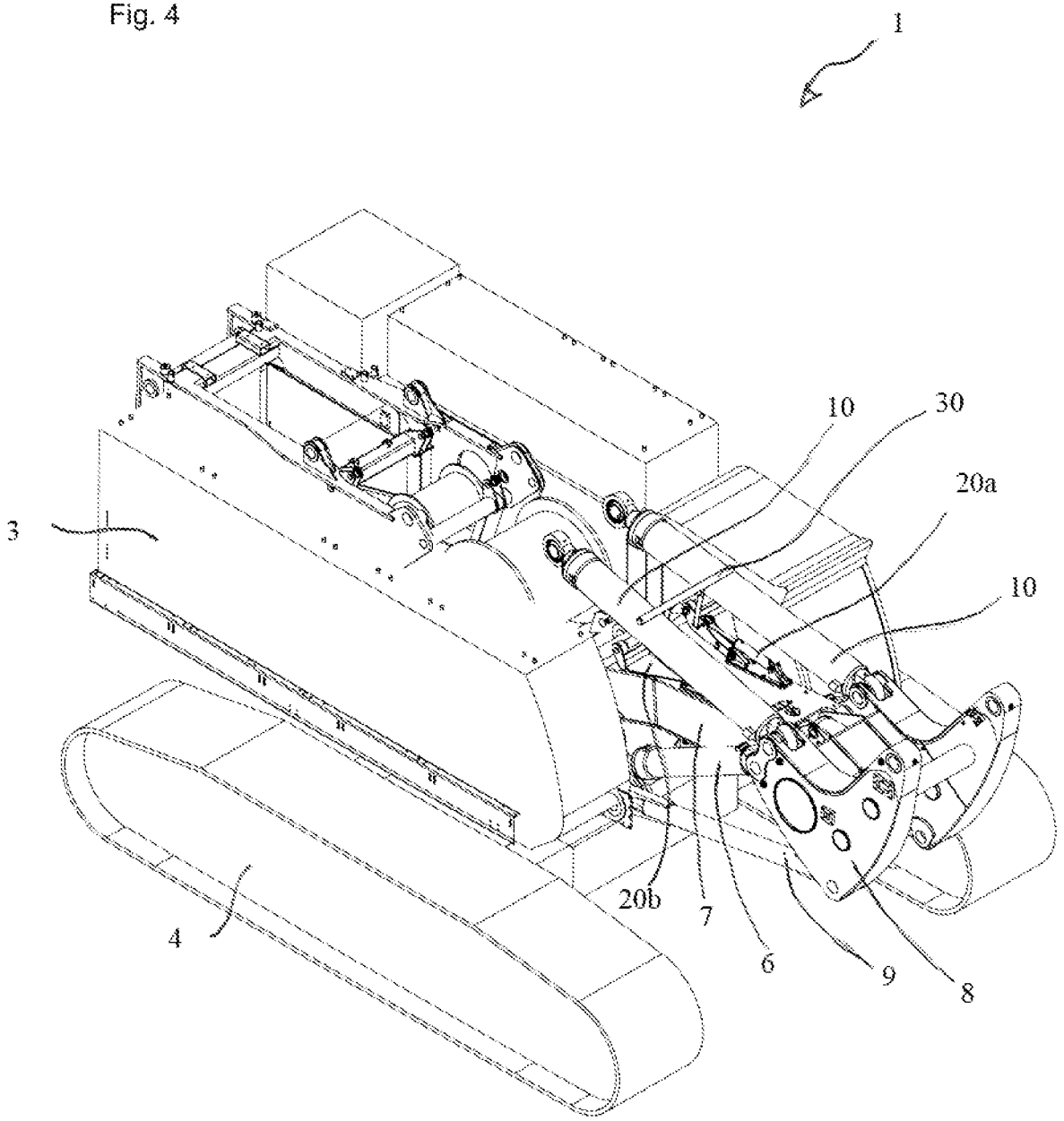
FIG. 4 is a perspective view of a drilling machine for building piles equipped with the assembling and moving equipment according to the present invention. The machine is in a configuration suitable for road transport, without the mast and the excavation equipment.

FIG. 4 shows a drilling machine 1, fitted with at least one assembling and moving equipment 20*a*, 20*b* according to the present invention, in a configuration suitable for road transport, which permits reducing its weight and dimensions. The machine is without the mast 5, the rotary 11 and the drilling assembly, such as a string of telescopic rods or kelly 13, and an excavation tool 14. Such missing components are transported separately on a different truck than the one used for transporting the machine 1. The machine 1 shown in FIG. 4 is equipped with a parallelogram-type kinematic mechanism, and comprises a pair of cylinders 10 arranged side by side. Conveniently, two assembling and moving equipments 20*a* and 20*b* are installed on the machine 1, one for each one of the two cylinders 10. In the transport configuration shown in FIG. 4, the kinematic mechanism is positioned in the fully lowered condition to reduce its height to a minimum.

In the configuration of FIG. 4, the weight and dimensions of the machine 1 are considerably reduced, so that even large-size machines can be transported on a truck without the need for dismounting the tracks to comply with the weight and height limits imposed by traffic regulations. This turns out to be advantageous because, when the site is arrived at, the machine with the tracks already installed can immediately get off the trailer and move autonomously on site.

In FIG. 4 it can be noticed that each assembling and moving equipment 20*a*, 20*b* is fixed, through its own support base, to the arm 7 of the machine, and is interposed between the arm 7 and the respective cylinder 10. More in detail, the cylinder 10 is connected to the kinematic frame or trapezium 8 through a first hinge 8 and rests on the support roller 24, which is adapted to support and move said cylinder 10. The assembling and moving equipment 20*a*, 20*b* is in the lowered configuration, i.e. with the roller 24 and the arm 23*a*, 23*b* in the position closest to the arm 7 and the moving actuator 22 in a substantially fully extended position. In this assembling or disassembling condition of the mast 5, the cylinder 10 has a second terminal hinge that is temporarily free and unconstrained from the respective joint 5*b* on the mast 5.

For increased safety during the road transport phase, a retaining tool (30) may optionally also be installed on the machine 1, to be preferably constrained to the assembling and moving equipments 20*a* and 20*b*, configured for holding the elongated component, in particular the first linear actuator, in particular the cylinder 10, in the lowered or transport position. The retaining tool 30 shown in the drawing is removably fixed to the moving arm 23*a* or 23*b* of each equipment 20*a* or 20*b*. If there are two or more cylinders 10, it is advantageous to employ a single retaining tool 30 to be constrained to both equipments 20*a* and 20*b*, as shown in FIG. 4. The retaining tool 30 is formed, in particular, by two elongated components (in particular, bars) integral with and oriented perpendicularly to each other. The first elongated element is fixed to the moving arm 23*a* or 23*b* and extends in a direction perpendicular to the moving arm 23*a*, 23*b*, e.g. for a length slightly exceeding the diameter of the component to be moved, in this case slightly greater than the diameter of the cylinder 10. The second elongated element of the retaining tool 30 extends in a direction transversal to the first elongated element, in particular substantially parallel to the axis of the support roller 24. Such second elongated element lies on the component to be moved, i.e. the cylinder 10 in this example, so as to hold said component in position. In this example, the retaining tool 30 has a "pi" shape, but many different shapes are also possible, including a "T" shape, etc. Thus, the cylinder 10 is locked between the support roller 24 and the retaining tool 30, which prevent it from moving in either direction about the hinge connecting it to the trapezium 8. During road transport, the retaining tool 30 will prevent the cylinder 10 from jolting relative to the support roller 24 because of vibrations and forces generated by rough road surfaces. To start mounting the mast 5 on the machine, it will be necessary to remove the retaining tool 30, so as to allow both assembling and moving equipments 20*a* and 20*b* to move freely and independently.

Figure 5:
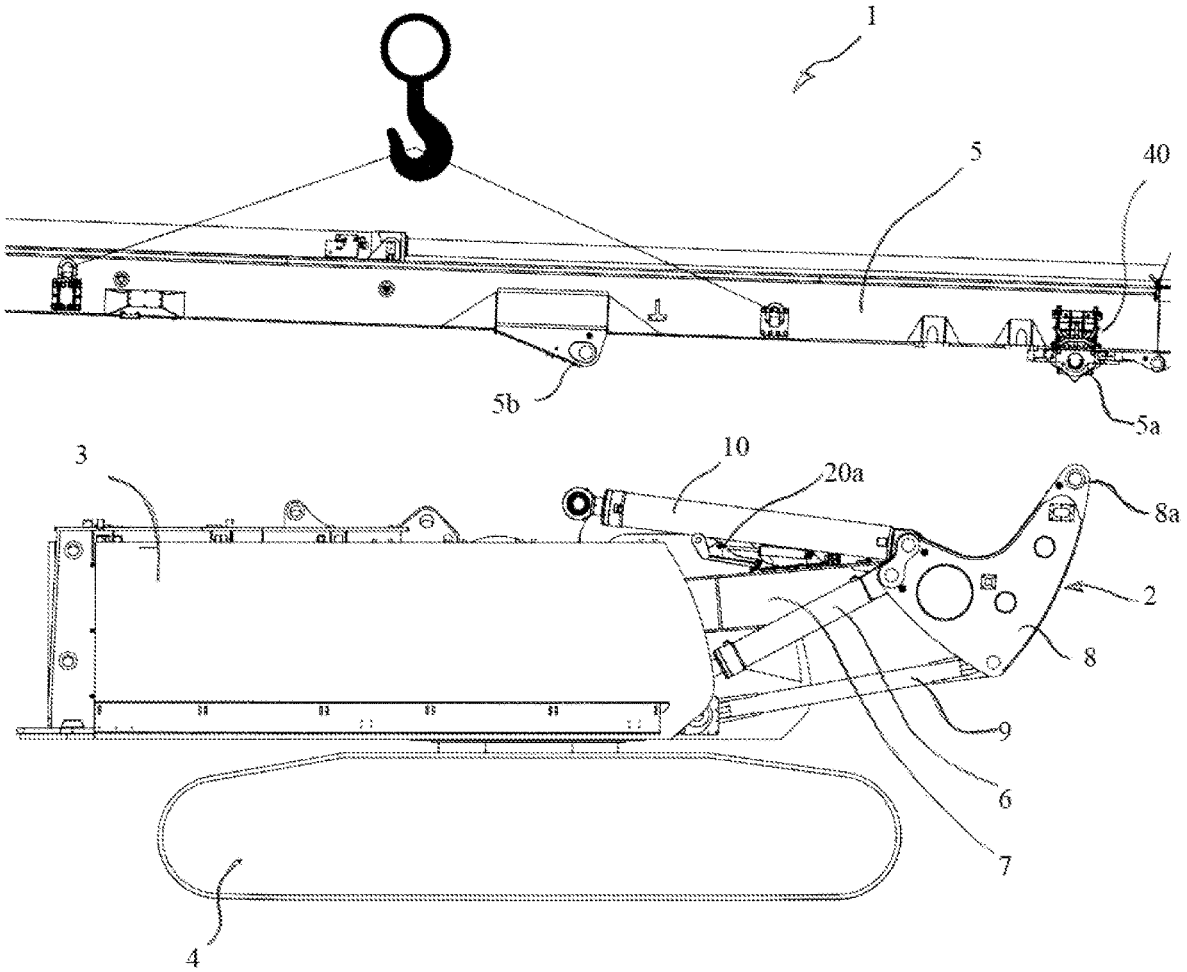
FIG. 5 is a side elevation view of a drilling machine for building piles equipped with the assembling and moving equipment according to the present invention. The machine is in an assembling or disassembling configuration, with the mast completely separated and unconstrained from the base machine.

FIG. 5 shows a condition that occurs during the initial phase of assembling the mast on the machine 1, e.g. when the machine has been transported separately from the mast 5 in order to reduce its transport weight and dimensions. Also, the condition shown in FIG. 5 may occur when first assembling the machine 1 at the production plant, when connecting the mast 5 to the kinematic mechanism 2. Likewise, the condition of FIG. 5 may occur at the end of the on-site work, when the mast 5 is to be disconnected from the machine 1 to be transported separately in order to reduce the weight and dimensions of the machine 1.

FIG. 5 will now be illustrated with reference to the phase of assembling the mast 5. Compared to the transport configuration phase shown in FIG. 4, in the initial assembling phase of FIG. 5 the kinematic mechanism 2, and in particular the arm 7, is raised slightly by means of the actuator 6 (particularly a linear actuator) for moving the arm 7, so that the hinge of the rod of the cylinder 10, adapted to be coupled to the mast 5, is higher than the turret 3 of the machine. This position of the rod hinge is more easily accessible to the personnel assembling the machine, and facilitates the subsequent insertion of the connecting pin between the cylinder 10 and the mast 5.

The mast 5 is transported in proximity to the machine 1 and slung by means of straps or chains connected to removable hoisting fittings provided on both sides of the mast 5. The mast 5 is hoisted by using a hoisting means such as a crane or a bridge crane. For simplicity and clarity, only the hook of such hoisting means is shown.

The mast 5 is moved over the turret 3, so that the joint 5*a* of the mast 5 is close to the fulcrum 8*a* of the kinematic support 8 and the joint 5*b* of the mast is close to the free hinge of the rod of the cylinder 10.

Figure 6:
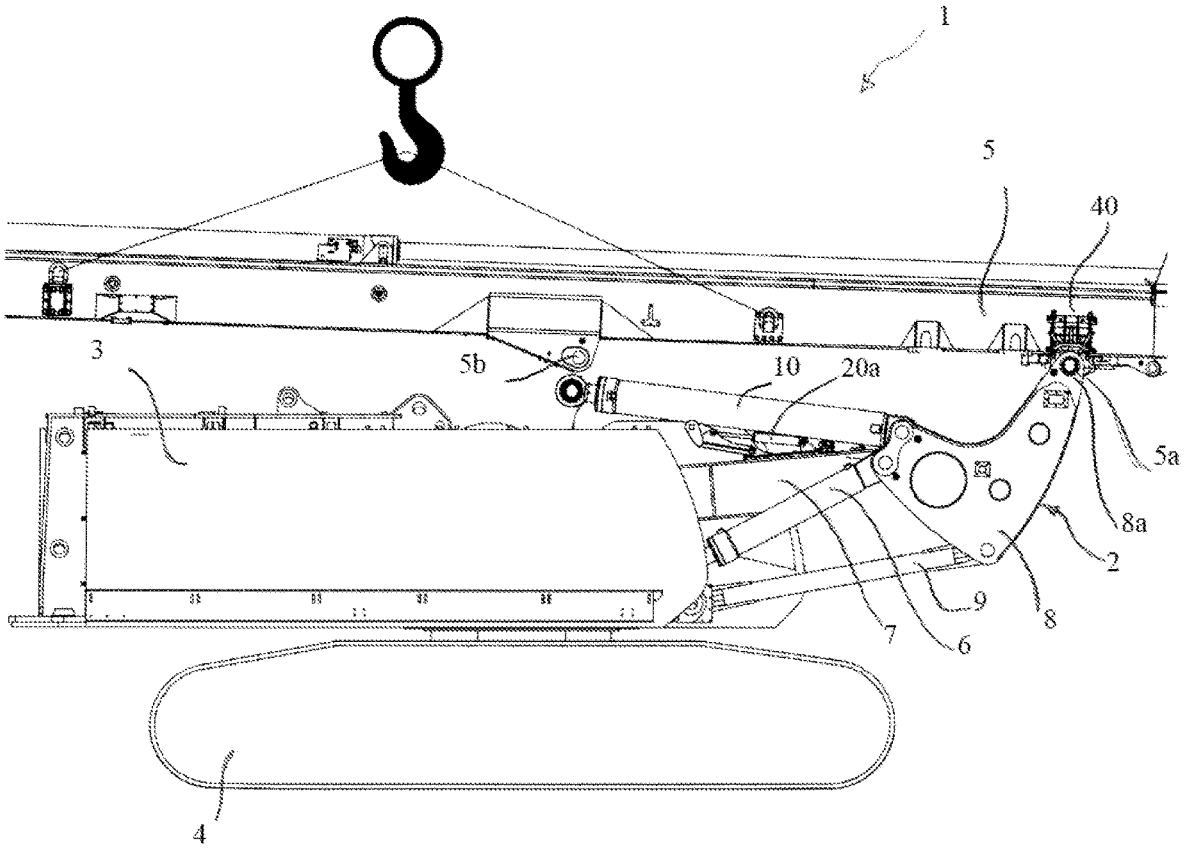
FIG. 6 is a side elevation view of a drilling machine for building piles equipped with the assembling and moving equipment according to the present invention. The machine is in an assembling or disassembling configuration, with the mast constrained to the base machine at one fulcrum.

The mast 5 is then moved by using an auxiliary hoisting means, such as crane, until the joint 5*a* of the mast 5 and the joint 8*a* of the kinematic frame 8 are coaxial, thus reaching the condition shown in FIG. 6. In this condition, the assembling personnel can insert the connecting pin between the mast 5 and the trapezium 8 through the joints 5*a* and 8*a*, thereby creating a first hinging constraint. The mast 5 must still be supported by a hoisting means, such as a support crane, because it has not been constrained in a stable manner yet, and could rotate about the fulcrum formed by the aligned joints 5*a*, 8*a*. In the condition of FIG. 6, the assembling and moving equipments 20*a*, 20*b* are still in the fully lowered position. The particular joints 5*a*, 5*b*, 8*a* shown herein by way of non-limiting example are holes intended to be crossed by pins to form a hinging connection. The moving actuators 22 are then operated in order to move the moving arms 23*a*, 23*b*. The actuators 22 are powered from hydraulic, electric or pneumatic systems of the drilling machine. The actuators 22 may be controlled by the machine operator through controls available in the cabin or, in one variant, through a remote control operated by an assembling operator, who will, in this case, stay at a point of greater visibility of the parts that need to be connected. The moving actuators 22 have a force sufficient to support and move the cylinders 10 for rotating the mast 5, causing them to rotate about their first fulcrum connecting them to the kinematic frame 8. During this movement, there is also some mutual rolling of the support roller 24 on the cylinder 10, due to the fact that the cylinder 10 and the moving arm 23*a*, 23*b* rotate relative to parallel axes that are distant from each other.

Figure 7:
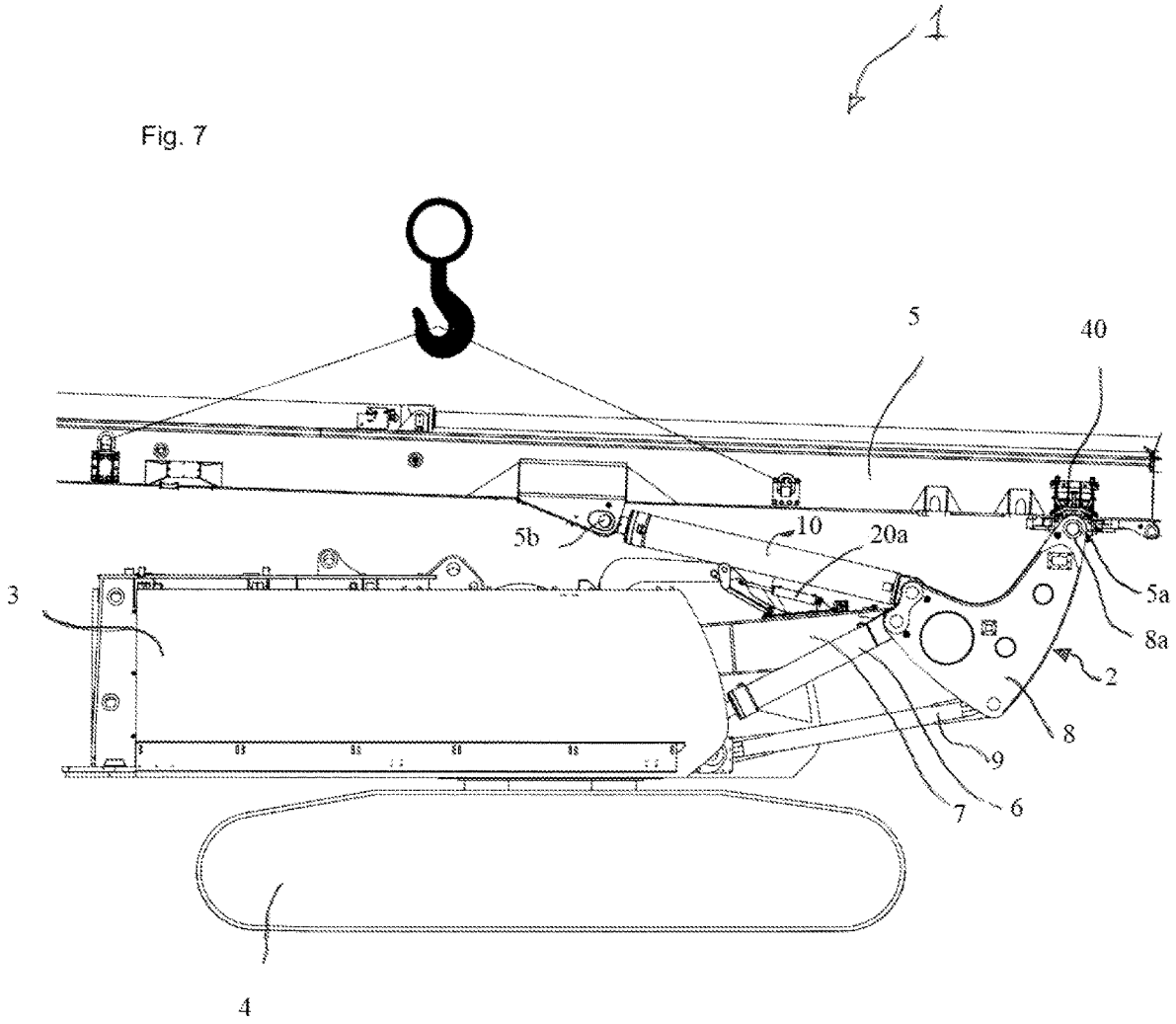
FIG. 7 is a side elevation view of a drilling machine for building piles equipped with the assembling and moving equipment according to the present invention. The machine is in a final assembling or initial disassembling configuration, with the mast constrained to the base machine at a first fulcrum and to the mast rotation cylinder at a second fulcrum.

Subsequently, the equipments 20*a* and 20*b* are moved in order to change the angle of inclination of the cylinders 10 until the free end of the cylinder 10, in particular of the rod of the cylinder 10, becomes coaxial to the joint 5*b* of the mast 5, as shown in FIG. 7. It is preferable that the various assembling and moving equipments 20*a* or 20*b* installed on the machine are powered by separate systems, so that the operator can control them independently one at a time. This turns out to be advantageous because, due to assembly tolerances and different precision levels, the two cylinders 10 may require slightly different rotations to achieve the precise alignment necessary for connecting them to the joint 5*b* of the mast 5.

Advantageously, when moving the cylinders 10 in order to switch from the condition of FIG. 6 with fully lowered cylinders 10 to the condition of FIG. 7 with oriented and raised cylinders 10, it is not necessary to use a second hoisting means, such as a service crane, in addition to the one being used for moving and supporting the mast 5. In order to achieve accurate coaxiality between the hinging point of the cylinder 10 (preferably, the rod associated with the cylinder 10 has a hinging hole) and the joint 5*b*, the operator in the cabin may also control the actuators 10 for changing the length thereof. This implies that the free end (in the example, the one including the hinging hole) of the rod of the cylinder 10, in addition to rotatably moving about the fulcrum for connection to the trapezium 8, may also move linearly in the longitudinal direction of the cylinder 10. Once coaxiality between the joint of the rod of the cylinder 10 and the joint 5*b* of the mast 5 has been achieved, the assembling personnel can insert the coupling pin that will hingedly constrain the cylinder 10 to the mast 5. In the condition of FIG. 7, with the pins inserted, the mast 5 has become stable and it is no longer necessary to support it by external hoisting means, such as a crane. Starting from the condition of FIG. 7, by actuating the cylinders 10 the mast 5 can then be raised and brought into a substantially vertical working condition again.

Figure 8:
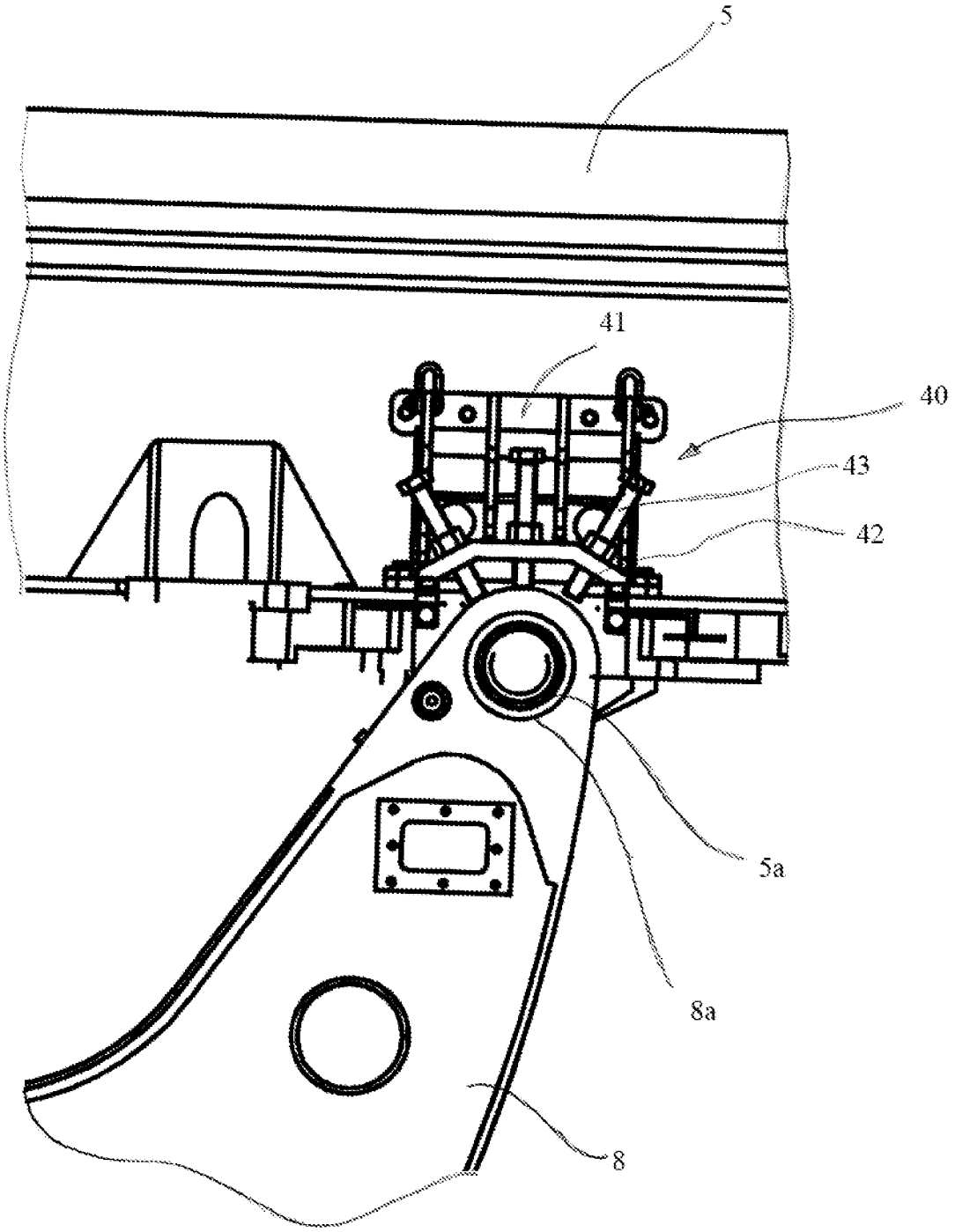
FIG. 8 is a detailed view of the area of the connection between the mast and the kinematic frame, which shows the positioning of a centring support according to a construction variant of the invention.

In a preferred construction variant, the machine 1 may comprise a centring support or device 40, e.g. installed on the mast 5 in proximity to the joint 5*a* connecting it to the trapezium 8, as visible in FIGS. 5, 6, 7 and, in particular, in FIG. 8, which is a detailed view. The centring support 40 comprises a fixing body 41 and an adjustment body 42. The fixing body 41 is adapted to be connected to the side of the mast 5, in proximity to the joint 5*a*. Preferably, on the side of the mast 5 there is a welded plate with threaded holes, whereon the fixing body 41 of the centring support 40 can be fastened by means of screws. The centring support 40 comprises the adjustment body 42, integral with the fixing body 41, which conveniently extends perpendicularly to the side of the mast 5. The adjustment body 42 has, in particular, a concave shape (e.g. a "bent tile" shape), and in particular comprises three sides (in general, a plurality of sides) and is centred on the hinging axis of the joint 5*a*. When the mast 5 and the trapezium 8 are in position, with the joint 5*a* substantially coaxial to the hinge 8*a* of the trapezium 8, the adjustment body 42 extends around the end of the trapezium 8, which has a semi-circular shape around the hinge 8*a*. There are a plurality of adjustment screws 43 going through the adjustment body 42, which 43 are conveniently adapted to engage with respective threads in said adjustment body 42. In particular, each one of the sides of the adjustment body 42 is crossed by one adjustment screw 43, which is screwed into the adjustment body 42. The longitudinal axes of the screws 43 are not parallel to one another. In the example, a first adjustment screw 43 is tilted towards the base of the mast 5, a second screw is perpendicular to the longitudinal axis of the mast 5, and a third adjustment screw 43 is tilted towards the head of the mast 5. Preferably, each screw has its own longitudinal axis passing through the centre of the joint 5*a* about which the mast 5 rotates relative to the trapezium 8.

By screwing or unscrewing the screws 43 it is possible to adjust the length of the screw 43 section that protrudes underneath the adjustment body 42. When the joint 5*a* of the mast 5 is brought closer to the joint 8*a* of the trapezium 8, the adjustment screws 43 can be made to abut on the body of the trapezium 8 that surrounds the respective joint 8*a*. This may facilitate centring the joint 5*a* with the joint 8*a* by adjusting the length of the screws 43. Once the adjustment screws 43 have come in abutment with the body that surrounds the joint 8*a*, by screwing in the screw 43 a thrust will be generated between the mast 8 and the trapezium 8, which will cause a small displacement of the mast 5, since it 5 has not been constrained yet. Due to the fact that the adjustment screws 43 are oriented in different directions, by screwing or unscrewing them it is possible to obtain very precise movements of the mast 5 in two directions in a plane perpendicular to the axis of the joint 5*a*, 8*a*. Through such adjustments one can achieve an accurate coaxial alignment between the joint 5*a* and the joint 8*a*, thereby facilitating the insertion of the connecting pin through the mast 5 and the trapezium 8. When the screws 43 are in the correct position to ensure a perfect alignment, they can be locked by means of a locknut. In this manner, during the next assembly operations it will no longer be necessary to repeat the adjustment, since it will suffice to rest the adjustment screws 43 on the semi-circular body of the trapezium 8 in proximity to the joint 8*a* to immediately obtain the coaxial alignment between the joint 5*a* of the mast 5 and the joint 8*a* of the trapezium 8.

The use of the centring support 40 turns out to be advantageous also during the phase of dismounting the mast 5, when switching from the condition of FIG. 6 to the condition of FIG. 5. In particular, when the machine is in the conditon of FIG. 6, wherein the mast 5 is connected to the kinematic mechanism 2 only at the fulcrum defined by the joints 5*a*, 8*a* of the kinematic frame 8 and is supported by slinging by a hoisting means, part of the weight of the mast 5 is transmitted to the connecting pin between the mast 5 and the kinematic frame 8. This weight part increases the friction between the joint pin and the two connected components (numbered as 5 and 8), thus making it more difficult to extract the pin. If at least one centring support 40 is installed on the mast 5, preferably one on each side of the mast 5, it is possible to screw in the adjustment screws 43, which, when abutting on the kinematic frame 8, will transfer thereto 8 such part of the weight of the mast 5, thereby relieving the pin. In this way, the connecting pin between the trapezium 8 and the mast 5 will be less subject to friction and will therefore be more easily removable to achieve the condition wherein the mast 5 is completely separated from the machine 1, as shown in FIG. 5.

It is to be understood that the use of the assembling and moving equipments 20*a*, 20*b* has been explained in detail herein with reference to the process of mounting and connecting the cylinders 10 for rotating the mast 5, but this does not prevent using such equipments for precisely moving any other component of the machine that needs to be constrained through two hinges located at its ends. It is therefore possible to constrain a first hinge and then use the assembling and moving equipment 20*a*, 20*b* to facilitate the assembling of a second hinge. For example, instead of the cylinder 10, the elongated component acted upon by the assembling and moving equipment 20*a*, 20*b* may be a connecting rod of the kinematic mechanism 2 or a further linear actuator hinged at its ends.

The invention also concerns a method for assembling a drilling machine 1. Starting from a condition wherein a structural element of the drilling machine 1 is released from the rest of the drilling machine 1, and wherein one end of the elongated component is released (FIGS. 4, 5), the method comprises the following steps:

bringing the structural element in proximity to an area of the drilling machine 1 where it has to be mounted, hinging the structural element to a part of the kinematic mechanism 2 at a first fulcrum, operating the assembling and moving equipment 20*a*, 20*b* so as to rotate the elongated component, hinging the free end of the elongated component to the structural element at a second fulcrum.

Conveniently, the structural element to be mounted is the mast 5. For example, the first fulcrum is defined by the connection of the joints 5*a*, 8*a*, and the second fulcrum is defined by the connection of the joint 5*b* with the end joint (in the example, a hole) of the cylinder actuator 10. In fact, the mast 5 is hinged to the kinematic mechanism 2 at two points or fulcrums.

With reference to the example, the elongated component is the first linear actuator with a rod and a cylinder 10, and there is a step of operating the first linear actuator in order to move the free end thereof (e.g. the left end of the cylinder actuator 10 in FIG. 6) for the purpose of connecting such free end to the structural element at the second fulcrum.

Further optional steps of the assembling procedure may include, for example:

removing the retaining tool 30, if present, or hinging the structural element to be mounted, e.g. the mast 5, through the use of the centring support 40.

For completeness' sake, and without any limitation, a particular procedure for assembling the mast 5 and the cylinders 10 through the use of the assembling and moving equipments 20*a*, 20*b*, starting from the transport condition of FIG. 4, can be summarized as including the following steps:

a) Transporting the mast 5 in proximity to the machine 1 and bringing it into the assembling condition b) Connecting the actuators 22 to their power supply circuit c) Removing the retaining tool 30 from the moving arms 23*a*, 23*b* d) Raising the kinematic mechanism 2 by operating the arm moving cylinders, until a configuration is obtained wherein the connection fulcrum 8*a* of the trapezium 8 is above the turret 3. Also the free hinge of the cylinders 10 is above the turret 3.

e) Positioning the mast 5 over the machine 1 by hoisting it through slings and by using an auxiliary hoisting means, such as a service crane. Positioning the mast with the joint 5*a* in proximity to the joint 8*a* of the kinematic frame 8. If centring supports 40 are present on the mast, abutting the adjustment screws 43 on the frame 8 in proximity to the joint 8*a* and adjusting the screws in such a way as to make the fulcrum 8*a* coaxial to the fulcrum 5*a* of the mast.

f) Inserting the connecting pins between the joint 5*a* of the mast and the mast rotation fulcrum 8*a* on the kinematic frame 8. The mast 5 and the trapezium will thus be mutually constrained at a first hinging axis.

g) Raising the mast rotation cylinders 10 by operating the actuators 22 of the assembling and moving equipments 20*a*, 20*b*. The two equipments should preferably be operated independently, moving a first equipment 20*a* while at the same time operating the corresponding mast rotation cylinder 10 in order to adjust its length. Once the fulcrum of the rod of the first cylinder 10 has been aligned in a coaxial position with the fulcrum of the joint 5*b* of the mast, the connecting pin is inserted. This task must be repeated for the other assembling and moving equipment 20*b* and for the corresponding mast rotation cylinder 10. Once the fulcrum of the rod of the second cylinder 10 has been aligned in a coaxial position with the fulcrum of the joint 5*b* of the mast, the connecting pin is inserted.

h) Restoring the hydraulic and electric connections between the base machine and the mast 5.

i) Restoring the turns of the ropes of the main and secondary draw-works.

j) Operating the mast rotation cylinders 10 in order to raise the mast and bringing into the vertical working position.

k) Installing the rotary and the excavation equipment on the mast.

The invention also comprises a method for disassembling the drilling machine 1, wherein the same steps as previously described are substantially carried out in reverse order. Merely by way of example, the particular procedure for dismounting the mast 5 and disconnecting the mast rotation cylinders 10 through the use of the assembling and moving equipments 20, starting from the working condition and arriving at the transport condition of FIG. 4, essentially consists of the reversal of the above-described steps, i.e.:

a) Disconnecting the rotary and the excavation equipment from the mast 5.

b) Operating the mast rotation cylinders 10 in order to lower the mast by rotating it and bringing it into a substantially horizontal position.

c) Disconnecting the hydraulic and electric connections between the base machine and the mast 5.

d) Positioning the kinematic mechanism 2 into a position suitable for dismounting the mast 5 by operating the arm moving cylinders, until a configuration is obtained wherein the connection fulcrum 8*a* of the trapezium 8 is above the upper structure 3. Also the free hinge of the cylinders 10 is above the upper structure 3.

e) Installing on the arm 7 the assembling and moving equipments 20*a* and 20*b*, if the latter had been dismounted prior to using the machine. Connecting them to the power supply systems of the machine.

f) Slinging the mast 5 over the machine 1 and supporting it by using an auxiliary hoisting means, such as a service crane. If centring supports 40 are present on the mast, abutting the adjustment screws 43 on the frame 8 in proximity to the joint 8*a* and adjusting the screws so as to transmit part of the weight of the mast directly to the external surface of the kinematic frame 8, thus relieving the weight from the connecting pin between the trapezium 8 and the mast 5.

g) Raising the moving arms 23*a*, 23*b* and the respective support rollers 24 by operating the actuators 22 of the assembling and moving equipments 20*a*, 20*b*. Bringing the support rollers 24 in abutment with the body of the mast rotation cylinders 10 as shown in FIG. 7. Removing the connecting pins between the rod of the mast rotation cylinders 10 and the joint 5*b* of the mast 5. The cylinders 10 are supported by the support rollers 24. The mast 5 is supported by the hoisting means.

h) Lowering the arms 23*a*, 23*b* of the equipments 20*a*, 2*b*, preferably by actuating them independently, until the arms and the cylinders 10 reach the lowered position of FIG. 6. The mast 5 is supported by the hoisting means.

i) Removing the connecting pins between the joint 5*a* of the mast and the mast rotation fulcrum 8*a* on the kinematic frame 8. The mast 5 and the trapezium will thus be completely released from each other.

j) Hoisting the mast 5 through the hoisting means and bringing it above the machine 1 in the fully released position, as visible in FIG. 5.

k) Laying the mast on the ground or on suitable supports, so that it can be prepared for transport on a distinct vehicle, other than the one used for the base machine.

l) Lowering the kinematic mechanism 2, so as to bring the kinematic frame 8 and the mast rotation cylinders 10 into a configuration as low as possible, suitable for transport.

m) Mounting the retaining tool 30 on the assembling and moving equipments 20*a*, 20*b* in order to lock the cylinders prior to transporting the base machine.

The invention also relates to a kit comprising the assembling and moving equipment 20*a* and 20*b*, and optionally also the centring support 40. Such kit can be easily mounted to and dismounted from a drilling machine 1 and ensures quick and safe installation of the components thereof, such as the mast 5. The use of the kit is advantageous for assembling or disassembling the drilling machine 1.

The present invention offers numerous advantages. Thanks to their elongated and slim shape, the assembling and moving equipments 20*a* and 20*b* can be left installed on the machine also when the machine is in operation. In fact, if the equipments 20*a* and 20*b* are kept in the fully lowered position, with the actuator 22 completely extended, they will never interfere with any other movable parts of the kinematic mechanism 2 or of the machine 1. This provides additional time savings when mounting or dismounting the mast because it will not be necessary to install and remove the equipments 20*a*, 20*b* each time. The equipments can nevertheless be dismounted at any time by simply removing the connection between the support base 21 and the arm.

The assembling and moving equipments 20*a*, 20*b* allow for precise and easily adjustable movements of the cylinders 10 both during the phase of mounting the mast 5 on the kinematic mechanism 2 and during the phase of dismounting and separating the mast from the kinematic mechanism. In particular, they avoid the need for simultaneously using several hoisting means for moving the mast and the cylinders at the same time. According to the present invention, the cylinders 10 are raised and oriented by means of said equipments.

The assembling and moving equipments 20*a*, 20*b* can advantageously be left installed on the machine even during the working phases, since they will not interfere with the movements of the parts of the kinematic mechanism or of the machine 1.

Of course, without prejudice to the principle of the invention, the forms of embodiment and the implementation details may be extensively varied from those described and illustrated herein by way of non-limiting example, without however departing from the scope of the invention as set out in the appended claims.

The invention claimed is:

1. A drilling machine comprising:

a main body, a mast, whereon a drilling tool is to be mounted, a kinematic mechanism configured for movably constraining the mast to the main body while allowing mutual rotation thereof, wherein the kinematic mechanism includes at least one elongated component configured for being hinged at two ends of the elongated component, wherein, when the drilling machine is in a drilling operating configuration, the at least one elongated component is hinged at the two ends and constrains the mast to the main body;

an assembling and moving equipment, comprising:

a moving element movably mounted to a portion of the drilling machine, and adapted to support the at least one elongated element, a moving actuator adapted to control a relative position between the moving element and the portion of the drilling machine to which the moving element is mounted;

wherein the assembling and moving equipment is configured in a manner such that, when the drilling machine is in an assembling configuration, in which one end of the at least one elongated component is released and the moving element is acting upon the at least one elongated component, movement of the moving element relative to the portion of the drilling machine to which the moving element is mounted will cause a rotation of the at least one elongated component;

wherein the moving element is adapted to assume:

an idle condition in which the moving element does not act upon the elongated element and is spaced apart from the elongated element; and an operating condition in which the moving element acts on the elongated element and rests on the elongated element.

2. The machine according to claim 1, comprising a support base adapted to be removably fixed to a portion of the drilling machine, wherein the moving element is mounted movably relative to the support base, and the moving actuator is adapted to control a relative position between the moving element and the support base.

3. The machine according to claim 2, wherein the moving arm is hinged to the support base, and the moving actuator is adapted to control relative angular position between the support base and the moving arm.

4. The machine according to claim 3, wherein the moving actuator is a linear actuator hinged to the support base and to the moving arm.

5. The machine according to claim 3, wherein the assembling and moving equipment is configured so that the support roller abuts on the cylinder.

6. The machine according to claim 2, wherein the support base is adapted to be fixed to the kinematic mechanism.

7. The machine according to claim 1, wherein the moving element comprises a moving arm hinged to the portion of the drilling machine, and the moving actuator is adapted to control relative angular position between the moving arm and the portion of the drilling machine to which the moving arm is hinged.

8. The machine according to claim 1, wherein the elongated component is a first linear actuator with a rod and a cylinder.

9. The machine according to claim 8, wherein one end of the first linear actuator is hinged to the mast.

10. The machine according to claim 1, wherein the moving element includes a freely rotatable support roller adapted to rest on the elongated component to allow the elongated component to slide on the support roller.

11. The machine according to claim 1, comprising a retaining tool configured for holding the elongated component in a lowered position, wherein the retaining tool is mounted to the assembling and moving equipment.

12. The machine according to claim 1, comprising a centring support adapted to be mounted to the mast, and comprising:

a fixing body adapted to be mounted to the mast, an adjustment body integral with the fixing body, a plurality of axially movable elements going through the adjustment body, wherein the longitudinal axes of the axially movable elements are nonparallel to one another;

the axially movable elements are configured so that axial position of the movable elements is user adjustable, and are adapted to abut on a portion of the kinematic mechanism to be hinged to the mast.

13. The machine according to claim 12, wherein the axially movable elements are adjustment screws.

14. The machine according to claim 1, wherein, when the elongated component is hinged at the two ends, the moving element is in the idle condition and not interfering with the hinged element; and wherein when the elongated component is not constrained at one end, the moving element is in the operating condition for moving or supporting said elongated component.

15. A method for assembling a drilling machine according to claim 1, starting from a condition in which a mast of the drilling machine is released from the drilling machine, and in which one end of the at least one elongated component of the kinematic mechanism is released and the other end of said at least one elongated component is constrained to the kinematic mechanism; the method comprises the following steps:

bringing the mast in proximity to an area of the drilling machine where the mast is to be mounted, hinging the mast to a part of the kinematic mechanism at a first fulcrum, operating the assembling and moving equipment to rotate the at least one elongated component, hinging the free end of the at least one elongated component to the mast at a second fulcrum.

16. The method according to claim 15, wherein the elongated component is a first linear actuator with a rod and a cylinder, and comprising the step of operating said first linear actuator to move a free end of the linear actuator, for connecting said free end of the first linear actuator to the mast at the second fulcrum.

17. A kit configured for installation on a drilling machine comprising:

a main body, a mast, whereon a drilling tool is to be mounted, a kinematic mechanism configured for movably constraining the mast to the main body while allowing mutual rotation thereof between the main body and the mast, wherein the kinematic mechanism includes at least one elongated component configured for being hinged at two ends, wherein, when the drilling machine is in a drilling operating configuration, the at least one elongated component is hinged at two ends of the at least one elongated component and constrains the mast to the main body;

wherein the kit includes an assembling and moving equipment comprising:

a support base adapted to be removably fixed to a portion of the drilling machine, a moving element movably mounted to the support base, and adapted to support the at least one elongated element, a moving actuator adapted to control relative position between the support base and the moving element;

wherein the assembling and moving equipment is configured so that, when the drilling machine is in an assembling configuration, in which one end of the at least one elongated component is released and the moving element is acting upon the at least one elongated component, movement of the moving element relative to the support base will cause a rotation of the at least one elongated component;

wherein the moving element is adapted to assume:

an idle condition in which the moving element does not act upon the elongated element and is spaced apart from the elongated element; and an operating condition in which the moving element acts on the elongated element and rests on the elongated element.

18. The kit according to claim 17, comprising a centring support adapted to be mounted to the mast, and comprising:

a fixing body adapted to be mounted to the mast, an adjustment body integral with the fixing body, a plurality of axially movable elements, in particular adjustment screws, going through the adjustment body, wherein the longitudinal axes of the axially movable elements are not parallel to one another;

the axially movable elements are configured in a manner such that a user can adjust their axial position, and are adapted to abut on a portion of the kinematic mechanism to be hinged to the mast.

19. The kit according to claim 18, wherein the axially movable elements are adjustment screws.

20. The kit according to claim 17, comprising a retaining tool configured for holding the elongated component in a lowered position, wherein the retaining tool is adapted to be mounted to the assembling and moving equipment.

21. The kit according to claim 17, wherein the moving element comprises a moving arm hinged to the support base, and the moving actuator is adapted to control a relative angular position between the support base and the moving arm.

22. The kit according to claim 21, wherein the moving actuator is a linear actuator hinged to the support base and to the moving arm.

23. The kit according to claim 17, wherein the moving element includes a freely rotatable support roller adapted to rest on the elongated component to allow the elongated component to slide on the support roller.

* * * * *